United States Patent [19]

Becker

[11] Patent Number: 4,853,068

[45] Date of Patent: Aug. 1, 1989

[54] HAND LABELING DEVICE

[75] Inventor: Werner Becker, Hirschhorn/N., Fed. Rep. of Germany

[73] Assignee: Esselte Meto International Produktions GmbH, Hirschhorn/N., Fed. Rep. of Germany

[21] Appl. No.: 162,254

[22] Filed: Feb. 29, 1988

[30] Foreign Application Priority Data

Feb. 27, 1987 [DE] Fed. Rep. of Germany ..... 3706433

[51] Int. Cl.[4] ..... B41F 1/46; B65C 11/02

[52] U.S. Cl. ..... 156/384; 101/288; 101/295; 101/324; 101/348; 156/579; 156/DIG. 49

[58] Field of Search ..... 156/384, 577, 579, DIG. 48, 156/DIG. 49; 101/288, 295, 305, 320, 324, 326, 348

[56] References Cited

U.S. PATENT DOCUMENTS

| | | | |
|---|---|---|---|
| 4,113,544 | 9/1978 | Sato | 156/384 |
| 4,273,046 | 6/1981 | Sato | 101/348 |
| 4,313,377 | 2/1982 | Sato | 101/295 |
| 4,699,685 | 10/1987 | Sato | 101/288 |
| 4,724,034 | 2/1988 | Becker | 101/288 |

FOREIGN PATENT DOCUMENTS

| | | | |
|---|---|---|---|
| 2645648 | 4/1977 | Fed. Rep. of Germany | 156/384 |

*Primary Examiner*—Michael Wityshyn

*Attorney, Agent, or Firm*—Gerald J. Ferguson, Jr.

[57] ABSTRACT

A hand labeling device is described with the aid of which in the course of an operating cycle self-adhering labels can be imprinted, dispensed and attached to articles. The operating cycle is controlled by means of an operating lever (26) pivotal out of a rest position into a pulled or squeezed position. In a device housing a printing mechanism (34) is arranged which comprises print types for producing an imprint on a self-adhering label disposed in a printing position. By a transport means (22) the self-adhering labels can be brought consecutively into the printing position and into the position for attachment to the articles. An inking device serves for inking the print types of the printing mechanism (34) before each printing operation; said device comprises an inking roll (46) which is held by a stirrup (51) pivotally mounted in the device housing and which on pivoting of the stirrup member (51) rolls on the print types of the printing mechanism (34). For producing a pivot movement about an axis (50) the stirrup member (51) is in drive connection with a rod (66), the displacement of which is controlled by the operating lever (26).

6 Claims, 6 Drawing Sheets

HAND LABELING DEVICE

Figure 1:
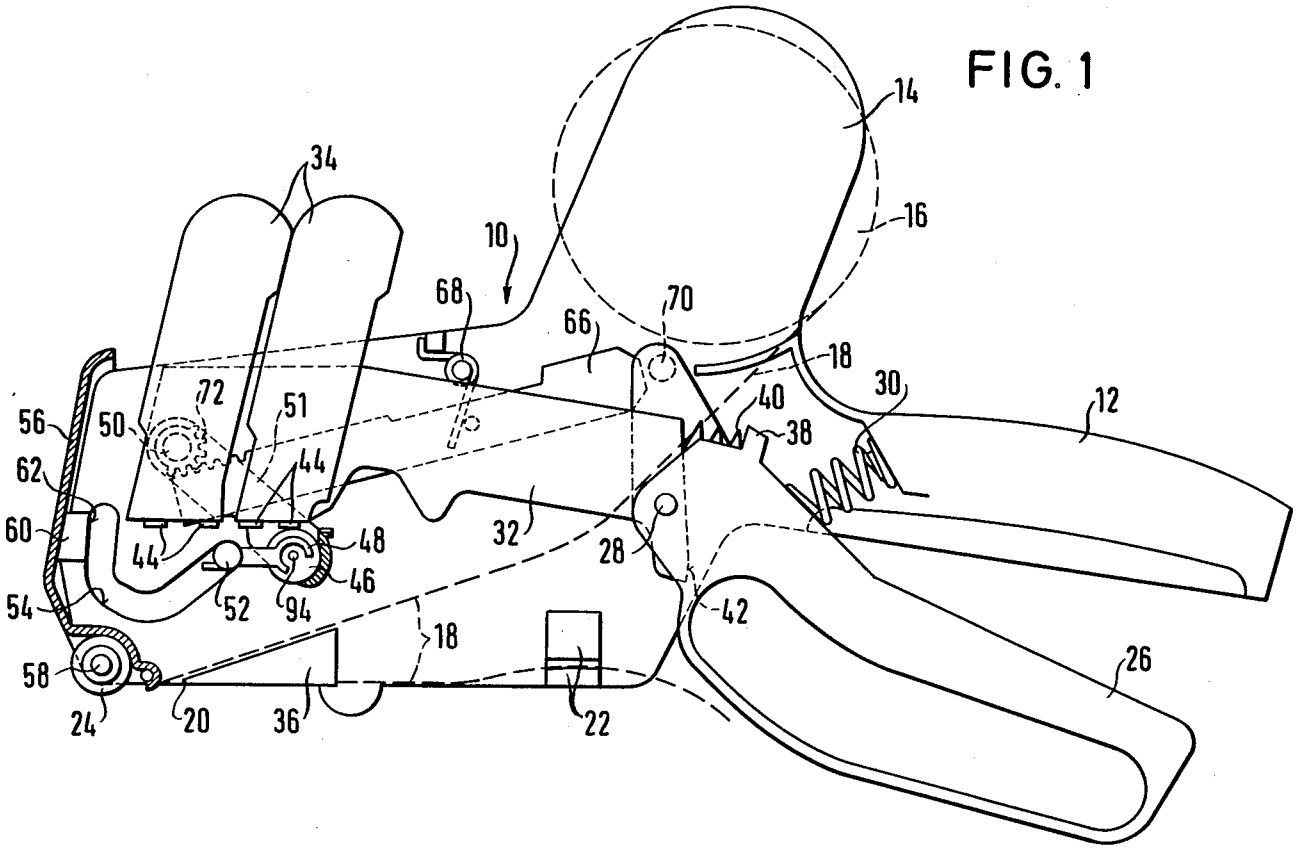

The invention relates to a hand labeling device for imprinting, dispensing and applying self-adhering labels to articles in the course of an operating cycle controlled by means of an operating lever pivotal out of a rest position into a pulled position, comprising a printing mechanism arranged in a device housing and having print types for producing an imprint on a self-adhering label disposed in a printing position, a transport means which brings the self-adhering labels consecutively into the printing position and into the position for application to the articles, and an inking device for inking the print types of the printing mechanism before each printing operation by means of an inking roll which is held by a stirrup member pivotally mounted in the device housing and on pivoting of the stirrup member rolls on the print types of the printing mechanism.

Such a labeling device is known from DE-OS No. 2,638,048. In this known device, by means of which labels can be imprinted in several lines, the stirrup member holding the inking roll is bendable at an articulation point so that a relatively long rolling path is achieved on the print types to be inked without the pivot radius, i.e. the distance between the pivot axis of the stirrup and the inking roll axis, having to be too large. During rolling of the inking roll on the print types the pivot stirrup member bends at the articulation point so that after execution of the inking it projects forwardly at the front side of the device like a bent knee. The device front side must therefore be open enough for the bent pivot stirrup member to project out. A further disadvantage of the wide projecting is that the operator's vision of the label to be applied is obstructed by the projecting pivot stirrup member so that it may happen that the label is applied to a point where it is actually not desired. The multipart construction of the stirrup member also has the disadvantage that after long use exact guiding of the inking roll is impaired because the articulation points wear loose.

In the known device the pivot movement of the stirrup member holding the inking roll is caused by the printing mechanism being lowered onto the inking roll on actuation of the device, whereupon a torque is exerted on the stirrup member which pivots the latter, the rolling of the inking roll on the printing types simultaneously taking place. If in the known device a rigid stirrup were used, as known for example from DE-OS No. 2,502,108, then a relatively large pivot radius would have to be employed to enable the inking roll to roll on all the print types and to pivot the stirrup member to such an extent that the path of the printing mechanism in the direction towards the label to be imprinted is not blocked. The long pivot radius necessary for this purpose requires however that the pivot axis be arranged at a relatively great distance in front of the pivot path of the printing mechanism. For if the pivot axis is too close to the path of movement of the printing mechanism then although the lowering movement of the printing mechanism can initially pivot the stirrup member with the inking roll with rolling of said roll on the print types, a blocking position then occurs in which the path of movement of the printing mechanism and the connecting line between the inking roll axis and the pivot axis of the stirrup member extend exactly tangentially. In this blocking position the printing mechanism no longer exerts any torque on the stirrup member so that the latter can also not be pivoted any further. This blocking state is prevented only if the pivot axis of the stirrup member lies far enough from the path of movement of the printing mechanism. The arrangement of the pivot axis of the stirrup member at a great distance from the path of movement of the printing mechanism results however in an enlargement of the device housing towards the front which is contrary to compact construction and which moreover is unfavourable for handling of the device because the operator can no longer see how exactly he is applying the particular imprinted label.

The invention is based on the problem of further developing a hand labeling device of the type outlined at the beginning so that even when using a multiline printing mechanism a compact construction can be achieved.

This problem is solved according to the invention in that the stirrup member for generating a pivot movement about an axis is in drive connection with a rod of which the displacement is controlled by the operating lever.

In the device according to the invention the pivot axis of the stirrup member can be arranged very close to the path of movement of the printing mechanism because the blocking position occurring as such in this case can be overcome by the action of the rod, i.e. in other words the stirrup member can still be further moved when the printing mechanism on its lowering movement no longer exerts any torque on said stirrup member.

Advantageous further developments of the invention are characterized in the subsidiary claims.

Figure 2:
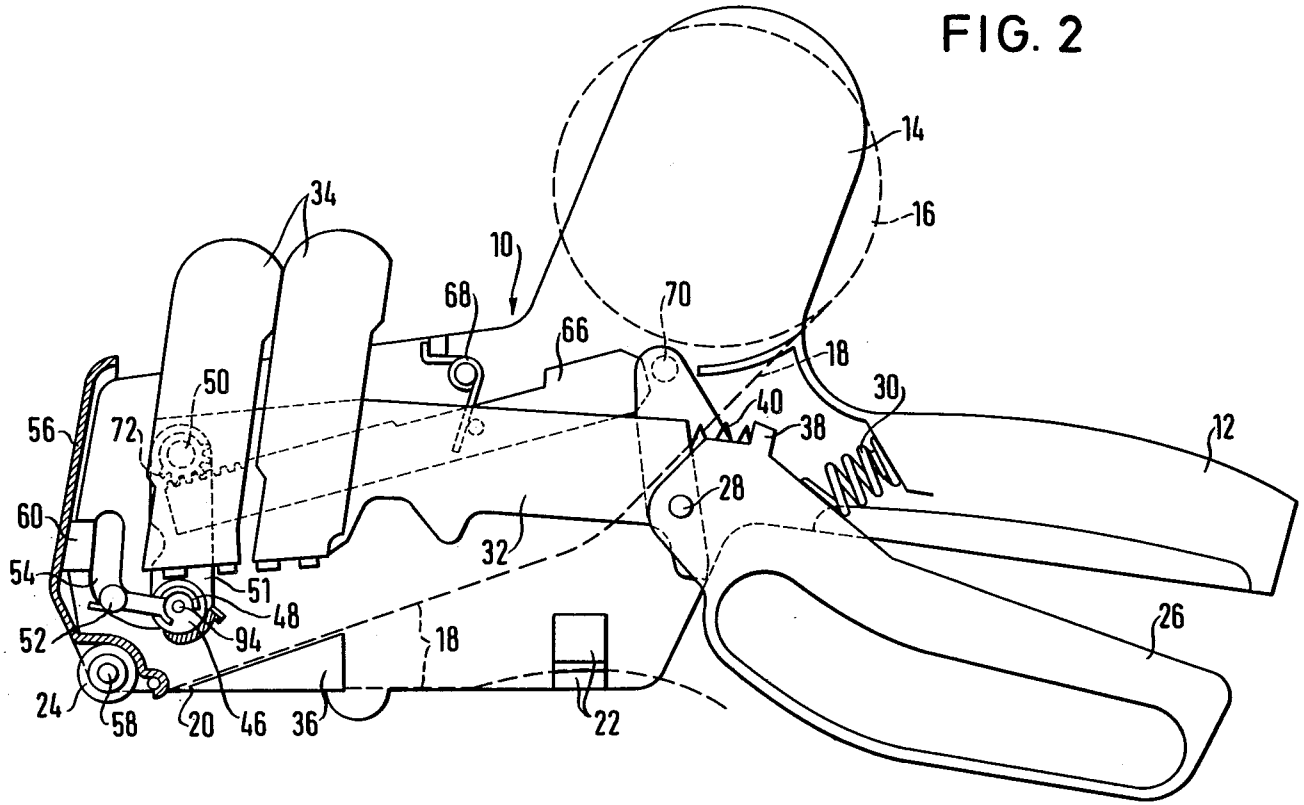
Figure 3:
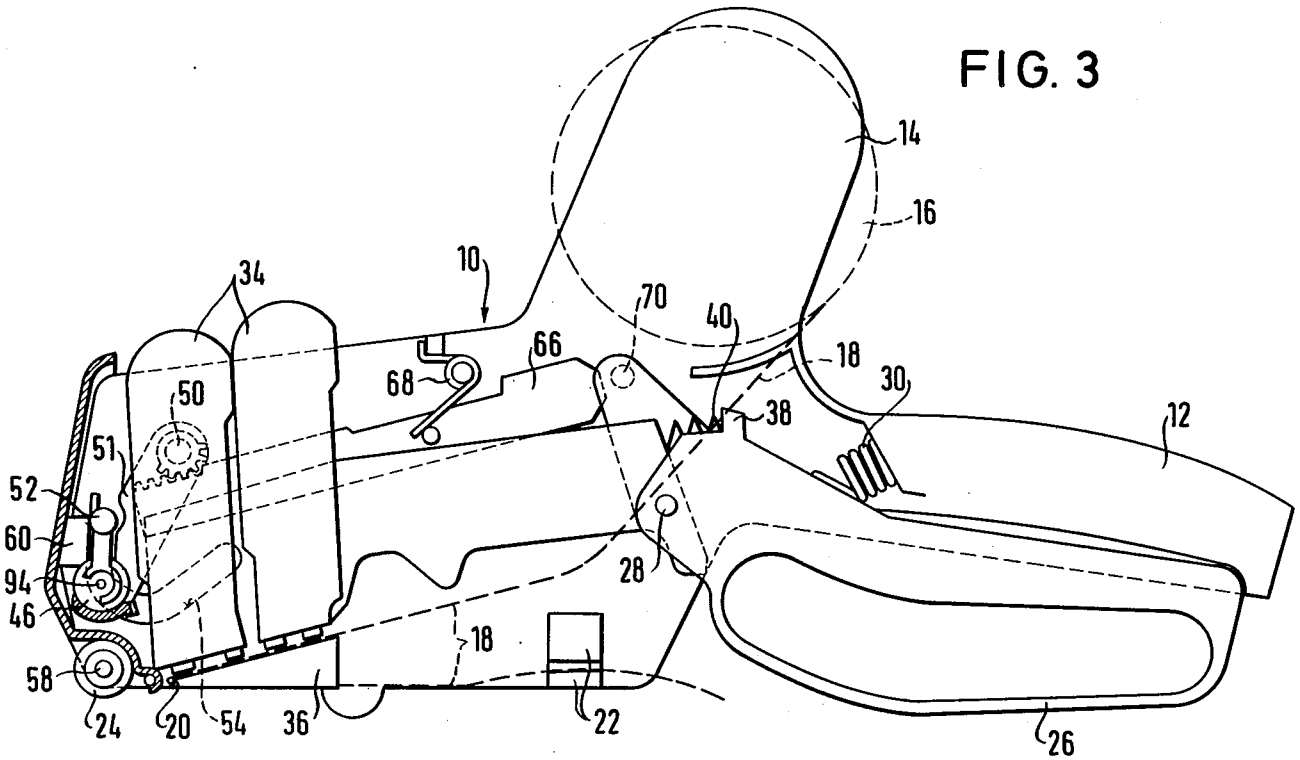
Figure 4:
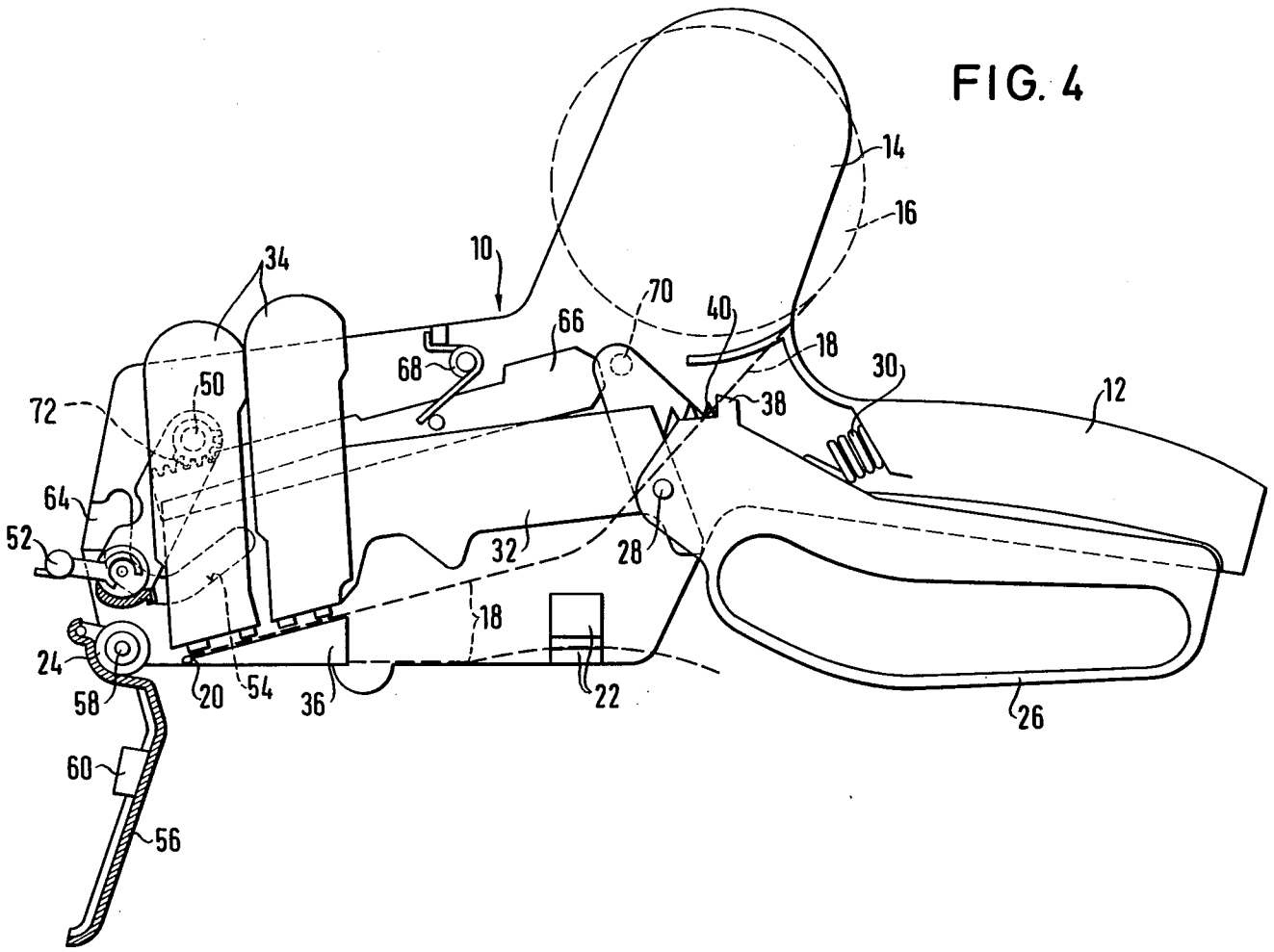
Figure 6:
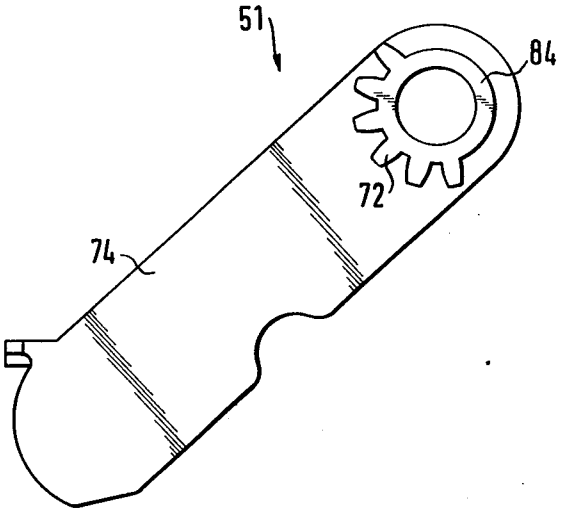
Figure 5:
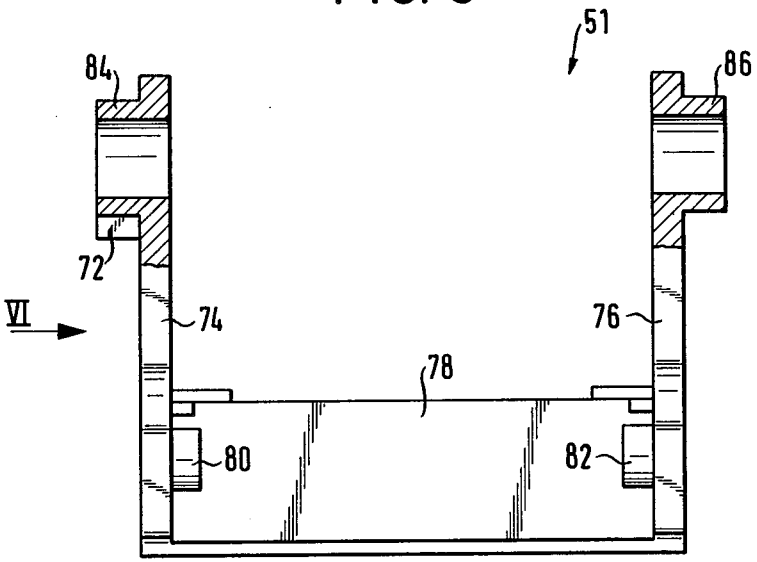
Figure 8:
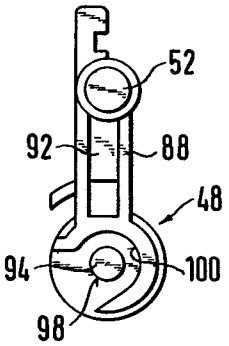
Figure 7:
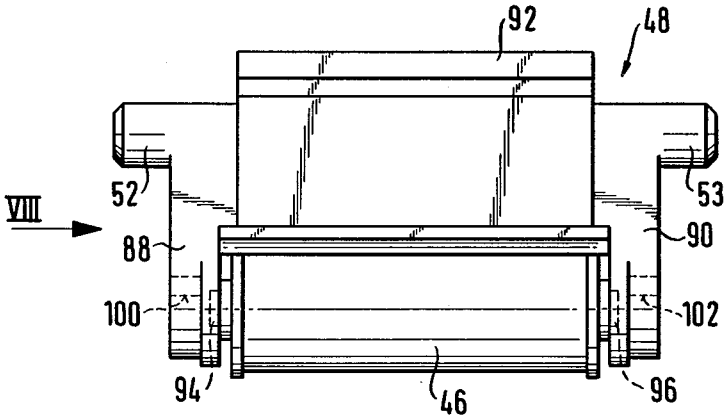

The invention will be explained by way of example with the aid of the drawings, wherein:

FIG. 1 is a schematic illustration of a hand labeling device according to the invention, the parts moving in the course of an operating cycle being in the rest position, FIG. 2 is a view of the device according to FIG. 1 after the start of an operating cycle when the printing mechanism has begun to move in the direction towards a label to be imprinted, FIG. 3 is a further view of the device of FIG. 1 at the instant when the printing mechanism meets a label to be imprinted, FIG. 4 is a similar view to FIG. 3 but the front flap of the device is open, FIG. 5 is an enlarged view of a pivot stirrup member carrying the inking roll holder in the device, FIG. 6 is a view of the pivot stirrup member from the side marked with an arrow in FIG. 5, FIG. 7 is a view of the inking roll holder with inserted inking roll and FIG. 8 is a side view of the inking roll holder from the side marked with an arrow in FIG. 7.

The hand labeling device illustrated in FIG. 1 serves to imprint and dispense self-adhering labels and attach them to articles. The device comprises a housing 10 on which a grip 12 is disposed. At the housing upper side there is a holder 14 for receiving a supply roll 16 of a carrier ribbon 18 on which self-adhesive labels stick. The carrier ribbon extends in the device from the supply roll 16 firstly downwardly and then in the direction to the front side of the device to a dispensing edge 20 at which the carrier ribbon 18 is deflected at an acute angle and is guided by a transport means 22 to the housing rear end. Rotatably mounted in the housing in front of the dispensing edge 20 is an application roller with which a label detached from the carrier ribbon 18 and disposed beneath the application roller in the dispensing position can be stuck onto an article.

Beneath the grip 12 an operating lever 26 is arranged which is pivotal about a pin or shaft 28. Between the grip 12 and the operating lever 26 there is a spring 30 which always tends to press the operating lever into the rest position illustrated in FIG. 1. Also located in the housing 10 is a printing mechanism support 32 which is also pivotally mounted about the shaft 28. Said printing mechanism support 32 carries a printing mechanism 34 with the aid of which a self-adhering label disposed on the printing table 36 can be imprinted. Between an arm 38 of the operating lever 26 and the printing mechanism support 32 a spring 40 is disposed which serves to transmit a movement of the operating lever 26 directed against the grip 12 to the printing mechanism support 32. In the rest position illustrated in FIG. 1 the printing mechanism support 32 is held in the raised position by an engagement face 42 on the operating lever 26.

The printing mechanism 34 comprises at its face facing the printing table 36 print types 44 which can be inked before each printing operation by means of an inking device. The most important part of the inking device is an inking roll 46 which is rotatably mounted in an inking roll holder 48. Details of the inking roll holder 48 will be explained hereinafter with reference to FIGS. 7 and 8. The inking roll holder 48 is mounted in turn in a stirrup member 51 which is pivotal about a shaft or pin 50 and the structure of which will be explained in connection with FIGS. 5 and 6.

Mounted on the inking roll holder 48 are two guide pins 52 and 53 which are guided in a guide track or path 54. The guideway apparent in FIG. 1 is in the inner face of the rear side wall of the housing 10, seen from the observer. A similar guideway 54 is disposed in the front side wall of the housing 10, not illustrated in FIG. 1. Accordingly, the inking roll holder 48 also has two guide studs or pins 52 and 53, each of which engages into one of the two guideways 54.

At the front side of the housing 10 there is a front flap 56 which can be pivoted about a shaft 58 forwardly into the open position shown in FIG. 4. The shaft 58 is at the same time also the shaft on which the application roller 24 is mounted. The front flap 56 is provided with an extension 60 which is directed toward the housing interior and the end face 62 of which forms part of the guide track 54. As apparent from FIGS. 1 and 4 the guideway 54 has towards the device front side an exit opening 64 which in the closed position of the front flap 56 is closed by the lug or extension 60. The purpose of this exit opening 64 will become apparent from the description of the mode of operation of the device described.

Between the operating lever 26 and the pivot stirrup member 51 a thrust rod 66 is disposed which with the aid of a spring 68 is biased in the direction towards a pin 70 on the operating lever 26. The rest position to which the thrust rod 66 is biased by spring 68 is shown in FIG. 1. The thrust rod 66 is formed at the end lying in the region of the stirrup member 51 as a rack. The stirrup member 51 comprises a pinion 72 which is in engagement with the teeth at the rack end of the thrust rod 66. It can be seen from the illustration of FIG. 1 that the stirrup member 51 is pivoted out of the rest position shown clockwise about the shaft 50 when the thrust rod 66 moves to the left.

In FIGS. 5 and 6 the stirrup member 51 carrying the inking roll holder 48 is shown in more detail. The stirrup member 51 comprises two arms 74, 76 which are connected together by a web 78. At the inner side the arms 74, 76 comprise in the region of the web 78 two pins 80, 82 which serve to mount the inking roll holder 48. Bearing bushes 84, 86 are disposed on the arms 74, 76 at the upper ends in FIG. 5 and with the aid of said bushes the stirrup member 51 can be rotatably mounted on pins which are disposed in the inner faces of the housing side walls. The teeth forming the pinion 72 are formed on a portion of the outer peripheral face of the bearing bush 84.

The guide pins 52, 53 are arranged according to FIG. 7 on the inking roll holder 48 in such a manner that they project laterally at arms 88 and 90 respectively. The arms 88, 90 are connected by means of a web 92. The inking roll 46 is secured between the arms 88, 90 of the inking roll holder 48; said roll comprises two journals 94, 96 which are shown in dashed line in FIG. 7 and each of which engages into a corresponding hole 98 in the associated arms 88, 90 of the inking roll holder 48.

Disposed on the outer face of the arms 88, 90 in the region of their lower ends in FIG. 7 are recessed 100 and 102 which are formed so that they can be placed over the pins 80, 82 on the stirrup member 51.

An operating cycle of the hand labeling device having the construction described above proceeds as follows:

When the operating lever 26 is pulled out of the rest position illustrated in FIG. 1 against the action of the spring 30 in the direction towards the grip 12 the movement of the operating lever 26 taking place anticlockwise about the shaft 28 is transmitted by means of the arm 38 and the spring 40 to the printing mechanism support 32. The printing mechanism support 32 therefore also rotates anticlockwise about the shaft 28 and thereby lowers the printing mechanism 34 in the direction towards the printing table 36. Via a lever connection, not illustrated, the transport means 22 is shifted to the left along the carrier ribbon 18 in the view of FIG. 1 due to the movement of the printing mechanism support 32.

The detailed structure of the transport means 22 is of no significance here; it must merely effect that in the course of each operating cycle of the device the carrier ribbon is pulled exactly one transport step corresponding to a label width round the dispensing edge 20 so that in each operating cycle a self-adhering label moves on the printing table 36 into a printing position. A transport means which can be used for this purpose is described for example in DE-PS No. 3,200,977.

Due to the lowering movement of the printing mechanism 34 connected to the printing mechanism support 32 the printing mechanism 34 exerts on the stirrup member 51 a torque which pivots the stirrup member 51 clockwise. In the course of this pivot movement of the stirrup member 51 the inking roll 46 rolls on the print types 44 so that the latter are inked. At the same time the guide pins 52 and 53 move in the guideway 54 in the direction towards the device front side. As soon as the stirrup member 51 has reached a position in which the movement direction of the printing mechanism 34 extends exactly tangentially to the connecting line between the axis 50 of the stirrup member 51 and the axis of the inking roll 46, the printing mechanism 34 can no longer exert any torque on the stirrup member 51.

Without taking further precautions a blocking state would occur and the stirrup member 51 would prevent the printing mechanism 34 reaching the label to be imprinted on the printing table 36. The thrust rod 66 ensures however that the stirrup member 51 is further pivoted beyond the blocking position clockwise and thus frees the path for further lowering of the printing mechanism. Until reaching the blocking position, due to the engagement between the pinion 72 and the end of the thrust rod 66 formed as a rack the stirrup member 51 has shifted the thrust rod 66 towards the left in the illustration of FIG. 2 against the action of the spring 68. However, as soon as the blocking position is reached the pin 70 disposed at the upper end of the operating lever 26 comes into engagement with the thrust rod 66 so that it moves the latter further to the left and this results in the stirrup member 51 being further pivoted in the direction towards the front side of the device. The position in which the thrust rod 66 starts to move the stirrup member 51 further is shown in FIG. 2. The pivot angle of the stirrup member 51 can be adapted to the particular requirements very simply by changing the diameter of the pinion 72.

Finally, the stirrup member with the inking roll holder disposed thereon is pivoted to such an extent that the printing mechanism 34 can move unrestricted downwardly in the direction towards the label disposed on the printing table 36. FIG. 3 shows the instant of the operating cycle at which the print types encounter the label disposed on the printing table 36 and generate the desired imprint. The guide pins 52, 53 are thereby at the end of the guideway 54.

At this instant in accordance with FIG. 3 the transport means 22 assumes its furthest left position. As soon as the operating lever 26 is released the transport means 22 moves back to the right again into its starting position illustrated in FIG. 1 but during this return movement it is fixedly connected to the carrier ribbon 18 so that it pulls the latter about the dispensing edge 20. During this movement of the carrier ribbon 18 the self-adhering label just imprinted detaches itself from the carrier ribbon and passes into a position below the application roller 24 in which it can be applied to an article.

When the operating lever 26 moves back again into its rest position illustrated in FIG. 1 the printing mechanism 34 lifts off the printing table 36 again and the spring 68 via its engagement with the thrust rod 66 and the action of the latter on the pinion 72 ensures that the stirrup member 51 also returns the inking roll holder to the starting position of FIG. 1.

In FIG. 4 the device described is shown with the front flap open. The front flap 56 must be opened or pivoted up when the inking roll 46 is to be replaced. To prepare for this replacement operation the front flap 56 is brought into the position illustrated in FIG. 4. Thereafter the operating lever 26 is pulled against the grip 12 until the printing mechanism 34 strikes the printing table 36. Since when the front flap 56 is open the exit opening 64 of the guideway 54 is open the guide pins 52, 53 in the course of their displacement can move through the exit opening 64 out of the guideway 54 into the position shown in FIG. 4. In the example of embodiment illustrated the guide pins 52, 53 automatically move out of the guideway 54 due to centrifugal forces when the operating lever 26 is pulled when the front flap 56 is open and the inking roll holder 48 is moved together with the inking roll 46 with relatively high speed. In this position the operator can grip the web 92 of the inking roll holder 48 and lift the inking roll holder 48 with the inking roll 46 mounted rotatably thereon out of the stirrup member 51. Preferably, the inking roll holder 48 and the inking roll 46 form a complete replacement unit so that it is not necessary to insert a new inking roll into the inking roll holder; instead, a new constructional unit consisting of an inking roll holder and an inking roll is simply inserted into the stirrup member 51. After the insertion the inking roll holder 48 is pivoted so that it assumes the position shown in FIG. 3 in which the guide pins 52, 53 lie in the guideway 54, whereupon the operating lever 26 is released and as a result the inking roll holder 48 moves back with the inking roll 46 into the position of FIG. 1. Thereafter the front flap 56 is closed so that the extension 60 again closes the exit opening 64. As a result the guideway 54 is also again closed so that the inking roll holder 48 is again guided via the guide pins 52, 53 and secured reliably in the device.

As already mentioned above in the inner face of each side wall of the housing 10 a guideway 54 is disposed so that accordingly two exit openings 64 are also present. The front flap 56 is thus also equipped with two lugs or extensions 60, each of which closes one of the exit openings 64.

In the further development of the hand labeling device described it is ensured that even when using a multiline printing mechanism a compact construction is achieved. Because of the drive of the stirrup member 51 which pivots the inking roll past the printing mechanism 34, said drive being effected by the thurst rod 66, the pivot point of said stirrup member can be shifted into the interior of the device housing to such an extent that an unnecessarily projecting form of the housing front side can be avoided since it would be unfavourable for the application of imprinted labels.

I claim:

1. A hand labeling device for imprinting, dispensing and applying self-adhering labels to articles in the course of an operating cycle controlled by an operating lever pivotal out of a rest position into a pulled position, the hand labeling device comprising a printing mechanism arranged in a device housing and having print types for producing an imprint on a self-adhering label disposed in a printing position, transport means for bringing the self-adhering labels consecutively into the printing position and into the position for application to the articles, and an inking device for inking the print types of the printing mechanism before each printing operation, the inking device comprising an inking roll which is held by a stirrup member mounted in the device housing pivotally about an axis and on pivoting of the stirrup member rolls on the print types of the printing mechanism, wherein the stirrup member (51) is in drive connection with a rod 66 whose displacement is controlled by the operating lever (26) and wherein the rod (66) comprises an end formed as a rack and the stirrup member (51) comprises a pinion (72) concentrically mounted on said axis (50) the pinion engaging the end of the rod (66) formed as rack.

2. Hand labeling device according to claim 1, characterized in that the rod (66) is spring-biased into a rest position.

3. Hand labeling device according to claim 1, characterized in that between the rod (66) and the operating lever (26) a predetermined play is present in the rest position of the rod and the operating lever.

4. A hand labeling device for imprinting, dispensing, and applying self-adhering labels to articles in the course of an operating cycle controlled by an operating lever pivotable out of a rest position into a pulled position, the hand labeling device comprising a multi-line printing mechanism arranged in a device housing and having print types for producing an imprint on a self-adhering label disposed in a printing position, transport means for bringing the self-adhering labels consecutively into the printing position and into the position for application to the article, and an inking device for inking the print types of the printing mechanism before each printing operation, the inking device comprising an inking roll which is held by a stirrup member mounted in the device housing pivotally about an axis and on pivoting of the stirrup member rolls on the print types of the printing mechanism, the pivoting of the stirrup member being caused by a lowering of said printing mechanism along a motion path towards a label disposed in the printing position, wherein the stirrup member (51) has a hinge-free structure and is in drive connection with a rod (66) for achieving a pivot movement about said axis, said axis (50) being disposed within the motion path of the printing maechanism (34), the displacement of the rod (66) being controlled by the operating lever (26), the rod (66) being spring-biased into a rest position, and a predetermined play between the rod (66) and the operating lever (26) being present in the rest position of the rod (66) and the operating lever (26).

5. A hand labeling device according to claim 4, wherein the rod (66) comprises an end formed as a rack and the stirrup member (51) comprises a pinion (72) concentrically mounted on said axis (50) the pinion engaging the end of the rod (66) formed as a rack.

6. Hand labeling device according to claims 1 or 4, characterized in that the rod (66) is secured linearly displaceably at an inner face of a side wall of the device housing.

* * * * *